US005333564A

United States Patent [19]

Ito

[11] Patent Number: 5,333,564

[45] Date of Patent: Aug. 2, 1994

[54] METHOD OF CONTROLLING STOPPING OPERATION OF A SEWING MACHINE AND SYSTEM THEREOF

[75] Inventor: Kazuhisa Ito, Aichi, Japan

[73] Assignee: Brother Kogyo Kabushiki Kaisha, Nagoya, Japan

[21] Appl. No.: 853,838

[22] Filed: Mar. 19, 1992

[30] Foreign Application Priority Data

Mar. 20, 1991 [JP] Japan ..... 3-56802

[51] Int. Cl.[5] ..... D05B 69/26

[52] U.S. Cl. ..... 112/275; 112/262.1; 318/369

[58] Field of Search ..... 112/275, 277, 262.1, 112/121.11, 67, 87; 318/369

[56] References Cited

U.S. PATENT DOCUMENTS

| | | | |
|---|---|---|---|
| 3,804,043 | 4/1974 | Benson et al. | 112/275 |
| 4,080,914 | 3/1978 | Ishida et al. | 112/277 |
| 4,765,267 | 8/1988 | Nakamura | 112/275 |
| 5,156,106 | 10/1992 | Suzuki et al. | 112/275 |

FOREIGN PATENT DOCUMENTS

| | | | |
|---|---|---|---|
| 0103364 | 3/1984 | European Pat. Off. . | |
| 0355095 | 3/1991 | Japan | 112/275 |
| 0426497 | 1/1992 | Japan | 112/275 |

*Primary Examiner*—Peter Nerbun
*Attorney, Agent, or Firm*—Oliff & Berridge

[57] ABSTRACT

A sewing machine stopping control system brings a sewing machine from a high-speed operation to a stop without varying modes and with high stopping accuracy, for allowing the sewing machine to operate highly efficiently. According to the stopping control system, a motor is decelerated in response to a release of a foot pedal. At a time when a predetermined rotational speed or lower is detected, the deceleration operation is disabled regardless of a decelerating command BKON outputted from a speed command comparing circuit. Thereafter, when a predetermined needle position is detected, the deceleration operation is resumed. When a predetermined low speed is detected during the deceleration, the deceleration operation is again disabled. Thereafter, when a predetermined needle position is detected, the deceleration operation is again resumed so that the motor is completely stopped.

23 Claims, 10 Drawing Sheets

METHOD OF CONTROLLING STOPPING OPERATION OF A SEWING MACHINE AND SYSTEM THEREOF

BACKGROUND OF THE INVENTION

The present invention relates to a method of controlling stopping operation (or shutdown operation) of a sewing machine and a system for controlling the sewing machine stopping operation. More specifically, the present invention relates to a method and a system for bringing a sewing machine from its high-speed operation into its stopped state.

Conventionally, in order to bring a sewing machine from its high-speed operation into its stopped state, as shown in FIG. 1(*a*), a motor employed in the sewing machine is decelerated until when its rotational speed N is decreased to a certain low level Na. After when the low speed of Na is detected, at the time t1 when a needle position sensor employed in the sewing machine detects a predetermined needle position (e.g., a lowermost needle position) H1, the motor of the sewing machine is finally decelerated to be completely stopped.

The sewing machine employing the above-described stopping operation control system, however, stops in different fashions or modes after it starts being decelerated until it finally stops at the predetermined needle position. More specifically, in a mode shown in FIG. 1(*a*), the lowermost needle position H2 is detected at the time t2 which is immediately before the time when the rotational speed Na is detected. Therefore, in the mode of FIG. 1(*a*), the motor continues to rotate at the low speed Na for about one needle stitch. In the case where the low speed Na is selected to be 200 rpm, therefore, the motor of the sewing machine has to continue to rotate at the speed of 200 rpm for a period of time L1 of about 300 ms. Accordingly, the period of time L2 from the time t0 when the sewing machine is started being decelerated to the timing t1 when the sewing machine is finally stopped becomes very long. Therefore, in the mode shown in FIG. 1(*a*), the stopping operation is retarded, resulting in poor operation efficiency.

On the other hand, in another mode shown in FIG. 1(*b*), the sewing machine can stop early, since the lowermost needle position is detected immediately after when the low speed Na is detected. In this case, the period of time L2 becomes very short.

As apparent from the above, the period of time L2 required for stopping the sewing machine depends on the relationship between the deceleration starting timing t0 and the needle position. Accordingly, different values of the period of time L2 are obtained for the respectively conducted stopping operations. In the conventional sewing machine, since the period of time L2 thus changes largely for each stopping operation, rhythms of the sewing machine stopping operation are not uniform, resulting also in poor operation efficiency.

SUMMARY OF THE INVENTION

In view of the aforesaid problems, it is an object of the present invention to provide a method and a system for controlling stopping operation of a sewing machine which can decelerate a sewing machine to be stopped with a substantially constant period of time, to thereby attain a uniform rhythm of sewing machine stopping operation.

To achieve the above object, there is provided a method of stopping a motor of a sewing machine which is rotating a main shaft of the sewing machine at an initial rotational speed, comprising the steps of: judging whether or not an initial rotational speed of a main shaft which is rotated by a motor of a sewing machine is higher than a predetermined first rotational speed, and decelerating the motor to decrease a rotational speed of the main shaft from the initial rotational speed toward the first rotational speed, in the case where the initial rotational speed is higher than the first rotational speed; starting decelerating the motor at the time when a needle operatively coupled to the main shaft is in a predetermined first position while the main shaft is rotating at a rotational speed equal to or lower than the first rotational speed, to thereby decrease the rotational speed toward a predetermined second rotational speed which is lower than the first rotational speed; and starting decelerating the motor at the timing when the needle is in a predetermined second position while the main shaft is rotating at the second rotational speed, to thereby completely stop the motor.

The deceleration operation of the motor to decrease the rotational speed of the main shaft toward the first rotational speed is stopped at the time when the rotational speed reaches the first rotational speed, and then the motor is allowed to continue rotating the main shaft at the first rotational speed until when the needle reaches the first position. The deceleration operation of the motor to decrease the rotational speed of the main shaft toward the second rotational speed is stopped at the time when the main shaft rotational speed reaches the second rotational speed, and then the motor is allowed to continue rotating the main shaft at the second rotational speed until the needle reaches the second position.

According to another aspect of the present invention, in a sewing machine which includes a motor, a main shaft rotatably driven by the motor, a needle operatively coupled to the main shaft, a decelerating unit for decelerating the motor, a speed detecting unit for detecting a rotational speed of the main shaft, a position detecting unit for detecting a position of the needle, and a control unit for receiving a stop command and controlling the decelerating unit to perform a stopping operation of the motor in response to the stop command, a method of stopping the motor of the sewing machine includes the steps of: allowing the control unit to judge whether or not an initial rotational speed of the main shaft is higher than a predetermined first rotational speed, the initial rotational speed being detected by the speed detecting unit at the time when the control unit receives the stop command; allowing the control unit to control the decelerating unit to decelerate the motor so that the rotational speed of the main shaft may be decreased to reach the first rotational speed, in the case where the initial rotational speed is judged to be higher than the first rotational speed; allowing the control unit to control the decelerating unit to start decelerating the motor, at the time when the needle reaches a predetermined first position while the main shaft is rotating at a rotational speed equal to or lower than the first rotational speed, so that the rotational speed of the main shaft may be decreased to reach a second rotational speed; and allowing the control unit to control the decelerating unit to start decelerating the motor at the time when the needle reaches a predetermined second position while the main shaft rotates at the second rotational speed, to thereby completely stop the motor.

According to further aspect of the present invention, there is provided a system for controlling the stopping operation of a sewing machine, including: a speed detecting unit for detecting a rotational speed of a main shaft of the sewing machine which is driven to be rotated by a motor of the sewing machine; a position detecting unit for detecting a position of a needle of the sewing machine which is operatively coupled to the main shaft; a decelerating unit for receiving a decelerating command and decelerating the motor in response thereto; first deceleration disabling means for disabling the deceleration operation of the decelerating unit irrespective of the decelerating command, at the timing when the rotational speed detected by the speed detecting unit becomes equal to or lower than a predetermined first rotational speed, after the decelerating unit receives the decelerating command; first deceleration resuming means for resuming the decelerating operation of the decelerating unit in accordance with the decelerating command, at the time when the position detecting unit detects a predetermined first needle position, while the first deceleration disabling means is in operation; second deceleration disabling means for disabling the deceleration operation of the decelerating unit, at the time when the speed detecting unit detects a predetermined second speed, while the first deceleration resuming means is in operation; and second deceleration resuming means for resuming the decelerating operation of the decelerating unit in accordance with the decelerating command to thereby completely stop the motor, at the time when the position detecting unit detects a predetermined second needle position, while the second deceleration disabling means is in operation, According to another aspect of the present invention, as shown in FIG. 2, there is provided a system for controlling the stopping operation of a sewing machine, including: a speed detecting unit 101 for detecting a rotational speed of a main shaft of the sewing machine which is rotatably driven by a motor of the sewing machine; a position detecting unit 100 for detecting a position of a needle of the sewing machine which is operatively coupled to the main shaft; a first speed command generating unit 106 for generating a sewing machine starting command, a sewing machine stopping command and a sewing machine speed command which are determined dependently on the depression state of an operating pedal; a second speed command generating unit 107 connected to the first speed command generating unit, for generating a low speed command or a plurality of second speed commands including the low speed command; a speed selecting unit 108 for selecting one of the speed commands generated by the first and second speed command generating units; a speed command comparing unit 109 for comparing the speed command selected by the speed selecting unit with an actual speed command indicative of an actual rotational speed of the motor, the speed command comparing unit generating a decelerating command in accordance with a difference value between the selected speed command and the actual speed command; a motor driving unit 110 connected to the speed command comparing unit, for driving the motor based on a drive command which is determined dependently on the difference value between the selected speed command and the actual seed command; a decelerating unit 112 connected to the speed command comparing unit for receiving the decelerating command from the speed command comparing unit and decelerating the motor 111 in response to the decelerating command; first deceleration disabling means 104 for disabling the deceleration operation of the decelerating unit irrespective of the decelerating command, at the time when the rotational speed detected by the speed detecting unit becomes equal to or lower than a predetermined first rotational speed, while the decelerating unit is decelerating the motor; first deceleration resuming means 102 for resuming the deceleration operation of the decelerating unit in accordance with the decelerating command, at the time when the position detecting unit detects a predetermined first needle position, while the first deceleration disabling means is in operation; second deceleration disabling means 105 for disabling the deceleration operation of the decelerating unit, at the time when the speed detecting unit detects a predetermined second speed, while the first deceleration resuming means is in operation; and second deceleration resuming means 103 for resuming the deceleration operation of the decelerating unit in accordance with the decelerating command to thereby completely stop the motor, at the time when the position detecting unit detects a predetermined second needle position, while the second deceleration disabling means is in operation.

When the first speed command generating unit 106 outputs the sewing machine starting command, the speed selecting unit 108 selects the speed command generated by the first speed command generating unit 106, and the speed command comparing unit 109 compares the speed command selected by the speed selecting unit with the actual speed command indicative of the actual rotational speed of the motor. The speed command comparing unit 109 outputs a drive command corresponding to the difference between the compared speed commands to the motor driving unit 110, which drives the motor at a prescribed rotational speed. The position detecting unit 100 produces an upper or lower needle position signal depending on the rotation of the main shaft of the sewing machine, and the speed detecting unit 101 produces a rotational speed signal indicative of the rotational speed of the main shaft of the sewing machine.

On the other hand, when the first speed command generating unit 106 outputs the sewing machine stopping command, the speed selecting unit 108 selects the low speed command generated by the second speed command generating unit 107. The speed command comparing unit 109 compares the selected speed command with the actual speed command. At the time when the difference value between the selected speed command and the actual speed command becomes equal to or more than a certain value, the speed command comparing unit 109 outputs the decelerating command, enabling the decelerating unit 112 to decelerate the motor 111 based on the decelerating command. When a rotational speed equal to or lower than the predetermined first rotational speed is detected by the speed detecting unit 101 during when the motor is being decelerated, the first deceleration disabling means 104 disables the decelerating unit 112 regardless of the decelerating command produced by the speed command comparing unit 109. When the deceleration disabling means is in operation, the deceleration resuming means 102 resumes operating the decelerating unit upon detection of a first predetermined needle position by the position detecting unit 100.

Finally, in response to detection of a predetermined second speed, the second deceleration disabling means 105 disables the decelerating unit 112. When the position detecting unit 100 detects a predetermined second needle position, the deceleration resuming means 103 controls the decelerating unit 112 to finally operate the decelerating unit 112 to completely stop the sewing machine at a given position.

Other objects, features and advantages of the present invention will become apparent in the following specification and accompanying drawings.

BRIEF DESCRIPTION OF THE ACCOMPANYING DRAWINGS

FIG. 1(*b*) is a diagram of a conventional stopping condition where the lowermost needle position is detected immediately after when the low speed Na is detected;

DETAILED DESCRIPTION OF THE PREFERRED EMBODIMENT

An embodiment of the present invention will hereinafter be described with reference to the drawings.

Figure 1A:
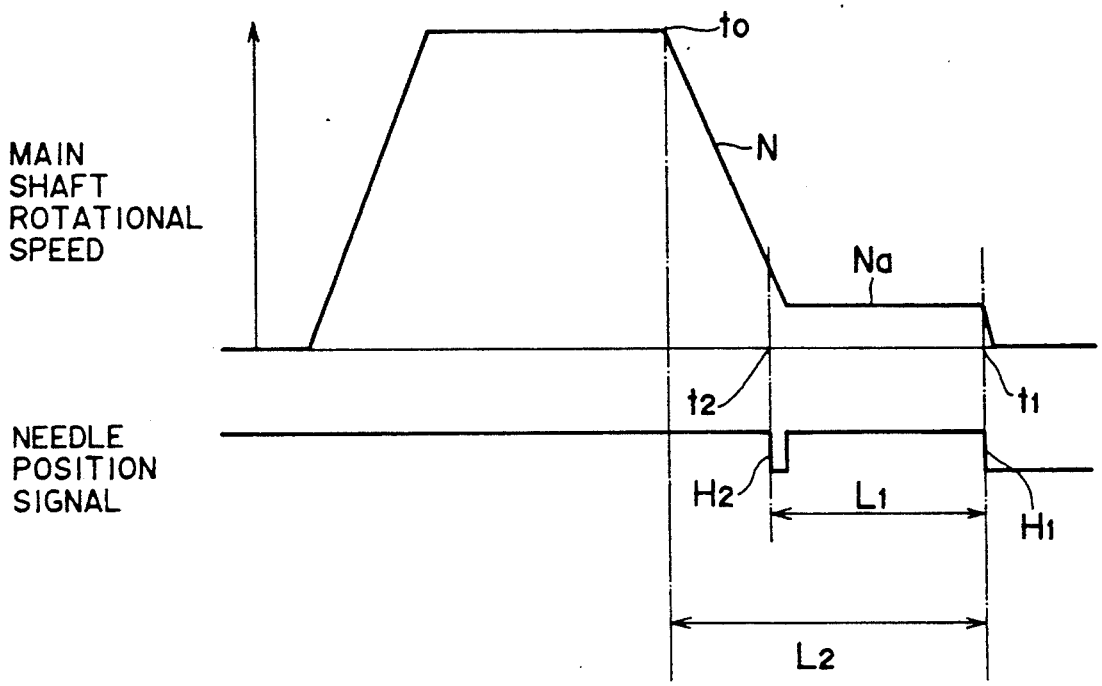
FIG. 1(*a*) is a diagram of a conventional stopping condition where the low speed Na is detected immediately after when the needle lowermost position is detected.
Figure 1B:
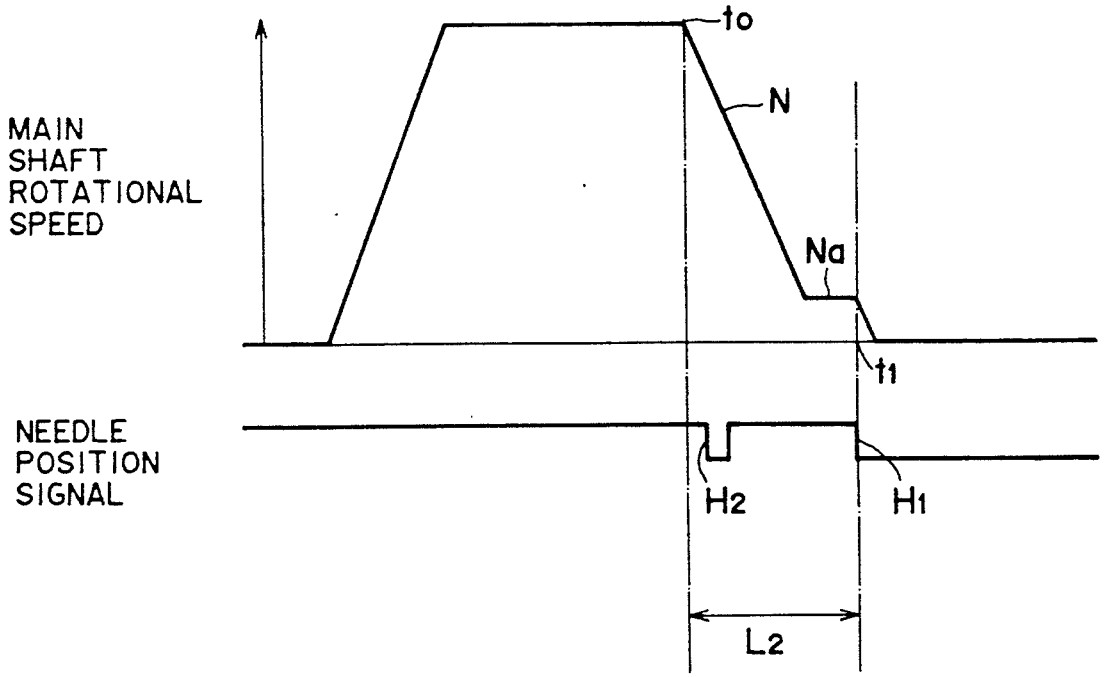
Figure 2:
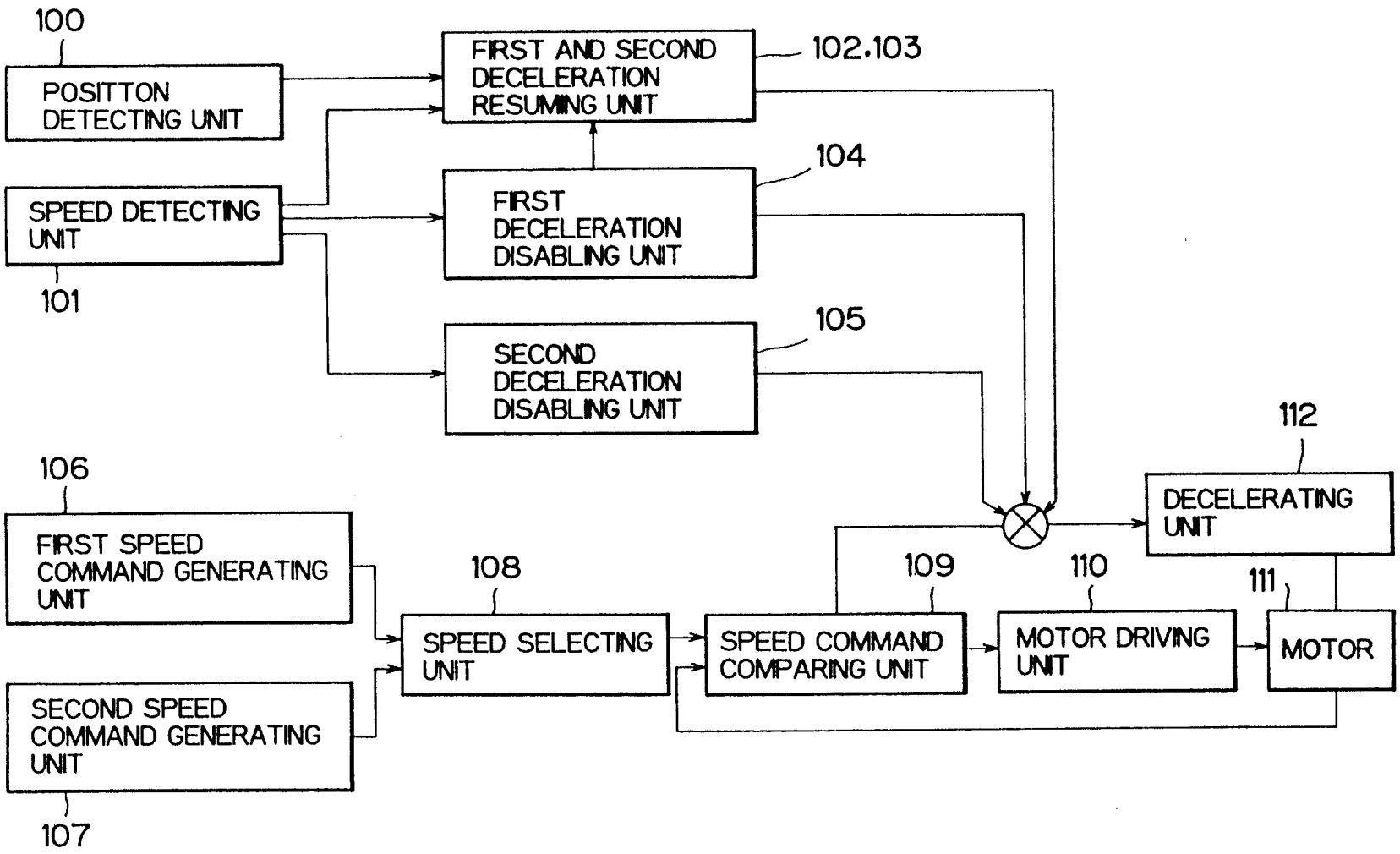
FIG. 2 is a block diagram of a system of the present invention.
Figure 3:
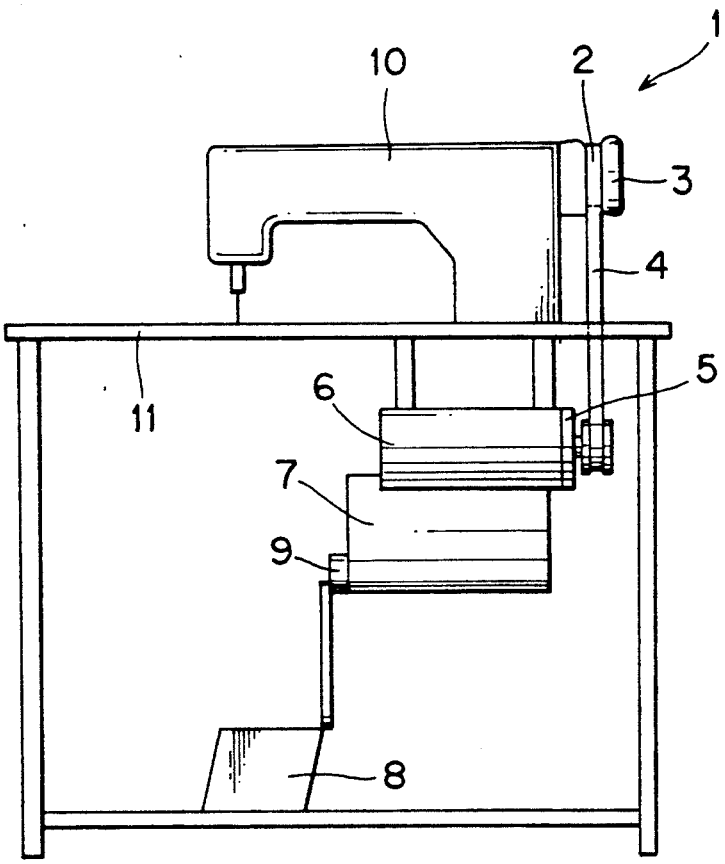
FIG. 3 is a front elevational view of a sewing machine according to an embodiment of the present invention.

As shown in FIG. 3, a sewing machine 1 of the present embodiment includes a motor 6 which serves as a driving source of the sewing machine. The motor 6 is operatively coupled to an upper main shaft (not shown in the drawing) housed in an arm portion 10 through a belt 4 and a pulley 3 so that the upper shaft may be driven to be rotated by the motor 6. A needle is operatively coupled to the upper main shaft to be moved upwardly and downwardly in accordance with the rotational movement of the upper main shaft. The motor 6 is operatively coupled also to a lower shaft (not shown in the drawing) housed in a bed portion 11 so that the lower shaft may be driven to be rotated by the motor.

The sewing machine 1 is provided with a brake member 5 for decelerating the rotational movement of the motor 6 in such a manner that the brake member 6 may be selectively engaged or connected with the motor 6 to thereby decelerating the rotational movement of the motor.

Figure 4:
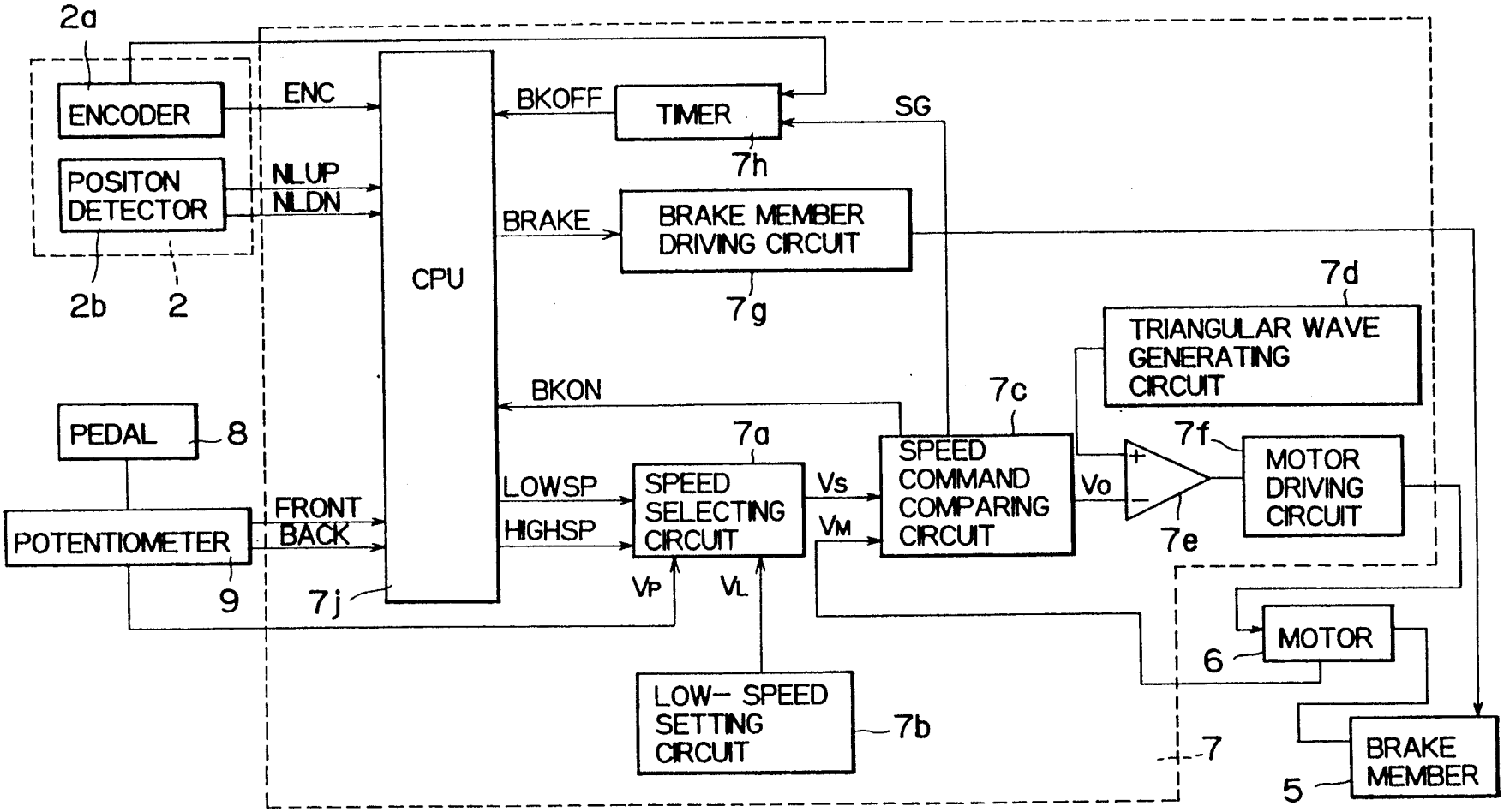
FIG. 4 is a block diagram of a control unit according to the embodiment of the present invention.

The sewing machine 1 is further provided with a motor controlling unit 7 for controlling the rotation of the motor 6. More specifically, as shown in FIG. 4, the motor controlling unit 7 includes a motor driving circuit 7*f* for driving the motor 6 to be rotated and a brake member driving circuit 7*g* for selectively allowing the brake member 5 to be engaged with the motor 6, to thereby decelerating the motor 6.

The upper main shaft is provided with a detector 2 for detecting a rotational speed of the upper main shaft and detecting a position of the needle. More specifically to say, as shown in FIG. 4, the detector 2 includes an encoder 2*a* for generating a fixed number of pulse signals while the upper main shaft attain each one rotation and a position detector 2*b* for generating needle position signals representative of positions of the needle. The detector 2 is connected to the motor controlling unit 7, and therefore the motor controlling unit 7 is supplied with information relating to the upper main shaft rotational speed and the needle position.

The sewing machine 1 is further provided with a foot pedal 8 to be depressed by an operator's foot. When the operator desires to start a sewing operation, the operator starts depressing a front region of the foot pedal 8. Accordingly, the front region of the foot pedal 8 is changed from its neutral position where the foot pedal is not depressed into its depressed position. In the case where the operator desires to increase a sewing speed to be attained by the sewing machine 1, the operator depresses the foot pedal 8 downwardly so that the depression amount may be increased. On the other hand, at the time when the operator desires to stop the sewing operation, the operator stops depressing the front region of the foot pedal 8. As apparent from the above, the depression amount of the foot pedal represents the operator's desired sewing speed, i.e., the operator's desired rotational speed of the motor 6. Furthermore, the fact that the front region of the foot pedal is started being depressed represents that the operator desires to start the sewing operation, but the fact that the front region is stopped being depressed represents that the operator desires to stop the sewing operation.

The foot pedal 8 is operatively coupled to a potentiometer 9 for detecting the state of the foot pedal 8 and for generating signals indicative of the state of the foot pedal. More specifically, the potentiometer 9 detects the fact that the front region of the foot pedal 8 is started being depressed and generates a command signal for starting the sewing operation. The potentiometer further detects the fact that the front region of the foot pedal is stopped being depressed and generates a command signal for stopping the sewing operation. The potentiometer also detects the depression degree of the foot pedal and generates command signals indicative of the operator's desired sewing speed. As shown in FIG. 4, the potentiometer 9 is connected to the motor controlling unit 7, and therefore the motor controlling unit 7 is supplied with information relating to the operator's desired sewing operation starting and stopping timings and the operator's desired sewing speed.

As apparent from the above, the motor controlling unit 7 controls the rotational speed of the motor 6 on the basis of the information on the operator's desired sewing operation starting and stopping time, the operator's desired sewing speed, the actually detected rotational speed of the upper main shaft, and the actually detected needle position.

The potentiometer 9, the detector 2 and the motor controlling unit 7 will be further described, in greater detail, hereinafter.

When the foot pedal 8 is depressed by the operator's foot, the potentiometer 9 detects a degree how the foot pedal 8 is depressed and generates an operator's desired speed signal Vp, a value of which represents the depression degree and therefore represents the operator's desired motor speed. In addition, the potentiometer 9 generates a forward depression signal FRONT and a rearward depression signal BACK dependently on which region of the foot pedal 8 is depressed. More specifically to say, when the front region of the foot pedal 8 is started being depressed, the potentiometer switches the signal FRONT from a high level (hereinafter referred to as "H") to a low level (hereinafter referred to as "L"). When the rear region of the foot pedal is depressed, the potentiometer switches the signal BACK from "H" to "L". Accordingly, when the operator desires to start the sewing operation, the operator starts depressing the front region of the foot pedal 8, and therefore the forward depression signal FRONT goes from "H" to "L". The change of the signal FRONT from "H" to "L" therefore serves as a sewing operation starting command signal. On the other hand, when the operator desires to stop the sewing operation, the operator stops depressing the front region of the foot pedal, and therefore the signal FRONT goes from "L" to "H". The change of the signal FRONT from "L" to "H" therefore serves as a sewing operation stopping command signal.

The generated signals FRONT and BACK are applied to the motor controlling unit 7.

The encoder 2*a* in the detector 2 generates pulse signals ENC of a fixed number (24) of pulses while the sewing machine upper main shaft makes each one revolution. The signals ENC will be utilized for detecting the rotational speed of the upper main shaft of the sewing machine, as will be described later.

Figure 5:
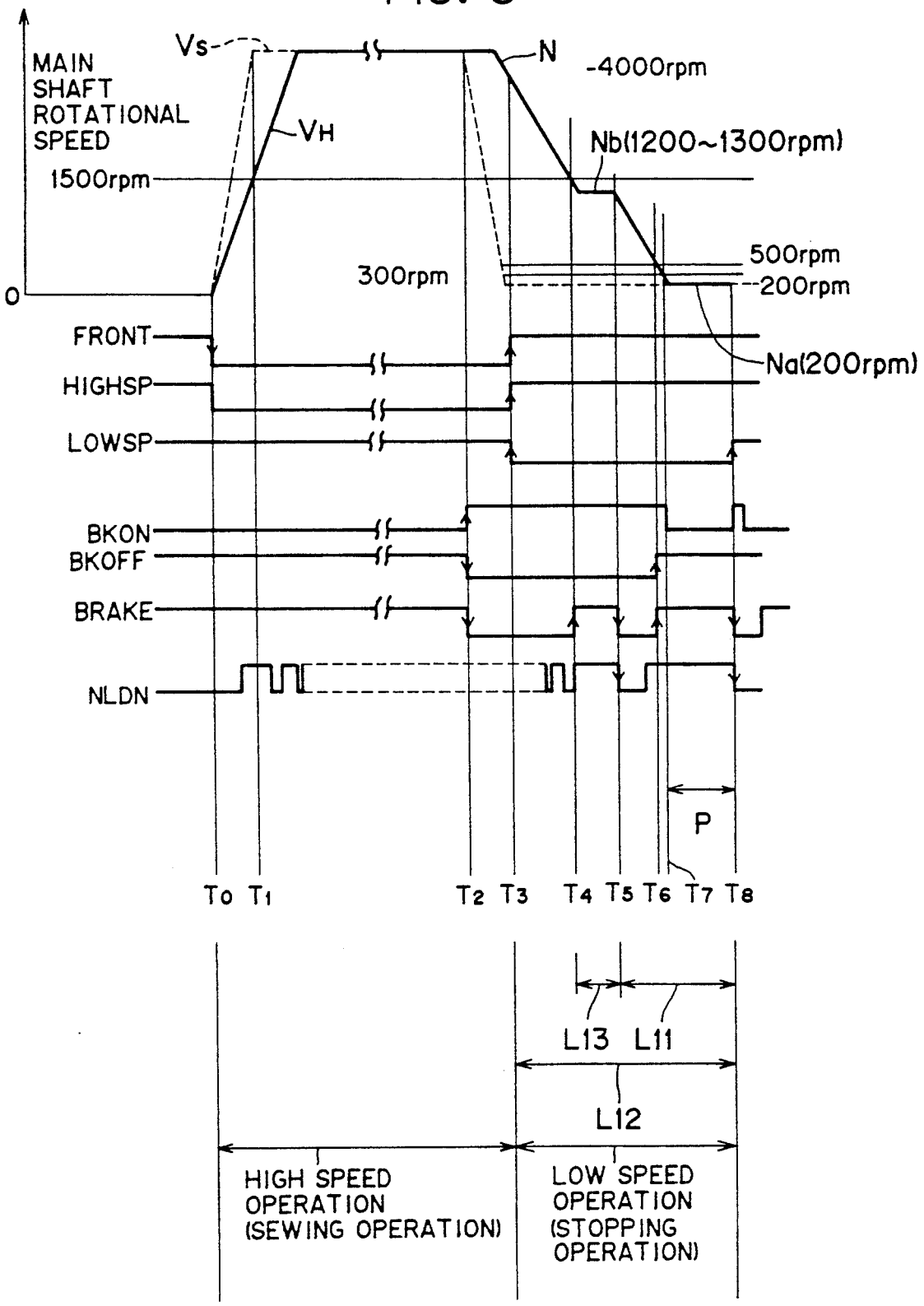
FIG. 5 is a timing chart of a control process for the sewing machine according to the present invention.

The position detector 2*b* generates an upper needle position signal NLUP at the time when the needle is in its uppermost position, and generates a lower needle position signal NLDN at the time when the needle is in its lowermost position. In other words, the position detector 2*b* generates the NLUP at the time when the detector 2*b* detects an ENC pulse indicative of a certain phase shift (60 degrees) of the upper main shaft, and generates the NLDN at the time when the detector 2*b* detects another ENC pulse indicative of another certain phase shift (240 degrees) of the upper main shaft. Accordingly, the position detector 2*b* generates one signal NLUP and one signal NLDN while the upper main shaft makes one revolution. The signals NLDN will be used for determining the time at which deceleration operation for the motor 6 is resumed to be conducted and at which final deceleration operation is started to be conducted, as will be described later. It is noted that, as shown in FIG. 5, each falling edge of signals generated by the position detector 2*b* represents the generation of the signal NLDN.

The pulse signals ENC generated by the encoder 2*a* and the needle position signals NLUP and NLDN generated by the position detector 2*b* are both applied to the motor controlling unit 7.

As shown in FIG. 4, the motor control unit 7 includes a central processing unit (CPU) 7*j*, a speed selecting circuit 7*a*, a low-speed setting circuit 7*b*, a speed command comparing circuit 7*c*, a timer 7*h*, a brake member driving circuit 7*g*, an operational amplifier 7*e*, a motor driving circuit 7*f* and a triangular wave generating circuit 7*d*.

The CPU 7*j* receives the signals FRONT and BACK which are outputted from the potentiometer 9, and outputs a high speed command signal HIGHSP and a low speed command signal LOWSP to the speed selecting circuit 7*a* in response to the received signals FRONT and BACK. More specifically to say, at the time when the signal FRONT changes from "H" to "L", the CPU 7*j* changes the signal HIGHSP from "H" to "L". The CPU 7*j* continues outputting the signal HIGHSP of "L" level until the signal FRONT changes from "L" to "H". The signal HIGHSP of "L" level is adapted for instructing the motor control unit 7 to control the rotational speed of the motor 6 to become equal to the operator's desired motor speed and to perform the operator's desired sewing operation. In other words, the signal HIGHSP of "L" level instructs the motor control unit 7 to perform a high speed operation. On the other hand, at the time when the signal FRONT changes from "L" to "H", the CPU 7*j* changes the signal HIGHSP from "L" to "H" and changes the signal LOWSP from "H" to "L". The CPU 7*j* continues to output the signal LOWSP of "L" until when the motor 6 is completely stopped being rotated. The signal LOWSP of "L" is adapted for instructing the motor control unit 7 to control the rotational speed of the motor 6 to become equal to a low speed which is set in the low-speed setting circuit 7*b* and stop the sewing operation. In other words, the signal LOWSP of "L" level instructs the motor control unit 7 to perform a low speed operation.

The low-speed setting circuit 7*b* establishes a low speed signal VL, a value of which indicates a low speed (200 rpm). When the sewing operation is to be stopped, the motor speed is decelerated to the low set speed (200 rpm), and then the rotation of the motor is finally decelerated to be completely stopped, as will be described later.

The speed selecting circuit 7*a* is supplied with the operator's desired speed signal Vp outputted from the potentiometer 9 and the low speed signal VL outputted from the low-speed setting circuit 7*b*. The speed selecting circuit 7*a* is further supplied with the high speed command signal HIGHSP and the low speed command signal LOWSP outputted from the CPU 7*jj*. The speed selecting circuit 7*a* outputs a speed command signal Vs to the speed command signal comparing circuit 7*c*, in response to the received speed signals Vp and VL and the command signals HIGHSP and LOWSP. More specifically to say, the speed selecting circuit 7*a* outputs the operator's desired speed signal Vp as the speed command Vs while the signal HIGHSP of "L" level is inputted to the speed selecting circuit 7*a*, i.e., during the high speed operation. The speed selecting circuit 7*a* outputs the low speed signal VL as the speed command Vs while the signal LOWSP of "L" level is inputted to the speed selecting circuit 7*a*, i.e., during the low speed operation. A value of thus obtained speed command signal Vs represents therefore an objective rotational speed of the motor 6 to be attained by the motor controlling unit 7, since the objective speed of the high speed operation is the operator's desired speed Vp, but the objective speed of the low speed operation is the low speed VL.

The speed command comparing circuit 7*c* receives the speed command signal Vs outputted from the speed selecting circuit 7a and an actual speed signal VM outputted from the motor 6, a value of which represents an actual rotational speed of the motor 6. The speed command comparing circuit 7c processes and amplifies the values of the signals Vs and VM, and outputs a differential speed command signal V0 to an input terminal of the operational amplifier 7e.

The speed command comparing circuit 7c further outputs an opposite phase command signal SG to the timer 7h. When the value of the actual speed signal VM is equal to or lower than that of the speed command signal Vs, the speed command comparing circuit 7c continues setting the opposite phase command signal SG to a high level "H" to thereby continue resetting the timer 7h, as will be described later. At the time when the value of the actual speed signal VM becomes higher than that of the speed command signal Vs, the speed command comparing circuit 7c sets the opposite phase command signal SG to a low level "L" to thereby allow the timer 7h to start time counting.

The speed command comparing circuit 7c further outputs a deceleration command signal BKON to the CPU 7jj. The signal BKON of a high level "H" is adapted for instructing the CPU 7j to allow the brake member 5 to be engaged with the motor 6 to thereby perform a motor speed decelerating operation. The speed command comparing circuit 7c changes the level of the signal BKON from "L" to "H", at the timing when the value of the actual speed signal VM becomes higher than that of the speed command voltage Vs (the objective speed) by a certain value (e.g., a voltage difference corresponding to −100 rpm) or more. In other words, the command for instructing the motor controlling unit 7 to perform the decelerating operation is issued, at the time when the actual rotational speed of the motor becomes higher than the objective speed by the certain value or more.

The operational amplifier 7è is supplied with the differential speed command signal V0, at its one input terminal, as described above. Another input terminal of the operational amplifier 7e is supplied with a triangular wave generated in a triangular wave generating circuit 7d. The operational amplifier 7e therefore outputs a pulse width modulation (PWM) signal to the motor driver circuit 7f.

The motor driver circuit 7f includes a power transistor module for driving the motor 6 based on switching operation of power transistors provided therein, in accordance with the PMW signals applied thereto.

The timer 7h includes a front-stage CR circuit which is chargeable and dischargeable with the ENC pulses from the encoder 2a and a rear stage latch circuit. The timer 7h receives the opposite phase command signal SG outputted from the speed command comparing circuit 7c. The timer 7h outputs a deceleration disabling command signal BKOFF to the CPU 7j for instructing the CPU 7j to disable the deceleration of the motor speed through disengaging or releasing the brake member 5 from the motor 6. More specifically to say, the signal BKOFF of high "H" is adapted for instructing the CPU 7j to disengage the brake member 5 from the motor 6.

The timer 7h sets and resets the signal BKOFF in response to the received signal SG. More specifically to say, during when the received signal SG continues to be "H", the timer 7h is reset and continues to set the signal BKOFF to "H". At the time when the opposite phase command signal SG goes from "H" to "L", the timer 7h latches the signal BKOFF to "L". The timer 7h continues to latch the signal BKOFF to "L" due to the time constant of the front-stage CR circuit, when the pulse width of the ENC pulses outputted from the encoder 2a becomes about 5 ms or more (which corresponds to a rotational speed of about 500 rpm or less). Then, the timer 7h changes the signal BKOFF from "L" to "H".

The CPU 7j outputs a brake signal BRAKE to the brake member driving circuit 7g. The brake member driving circuit 7g is adapted for driving the brake member 5 to be selectively engaged with the motor 6 or to be selectively disengaged therefrom, dependently on the signal BRAKE. More specifically, the signal BRAKE of low level "L" is adapted for instructing the driving circuit 7g to allow the brake member 5 to be engaged with the motor 6 to decelerate the rotational speed of the motor 6. On the other hand, the signal BRAKE of high level "H" is adapted for instructing the circuit 7g to control the brake member 5 to be released from the motor 6 to thereby disable the deceleration operation of the rotational speed of the motor 6. The CPU 7j outputs the signal BRAKE of "L" to perform the motor decelerating operation, when the CPU receives the signal BKON of "H". It should be further noted that even when the CPU receives the signal BKON of "H", in the case where the CPU receives the signal BKOFF of "H" or in the case where the CPU sets a flag for the signal BKOFF of "L" to ignore the signal BKOFF of "L", the CPU outputs the signal BRAKE of "H" for instructing the deceleration disabling operation, as will be described later.

Operation of the sewing machine 1 according to the present invention will be described below with reference to FIGS. 5 through 10.

FIG. 5 shows a sequence in which the sewing operation of the sewing machine 1 is started to be stopped. More specifically to say, in FIG. 5, the operator starts depressing the front region of the foot pedal 8 at the time T0, to change the foot pedal from its neutral position to its depressed position. The depression amount of the foot pedal gradually increases from the time T0 to the time T1. The foot pedal continues being depressed with the maximum depression amount from the time T1 to the time T2. Then, the depression amount of the foot pedal is decreased from the time T2 to the time T3. At the time T3, the operator stops depressing the foot pedal to change the foot pedal from its depressed position to its neutral position. As a result, the motor 6 of the sewing machine is decelerated as will be described later to be finally stopped at the time T8.

Figure 6:
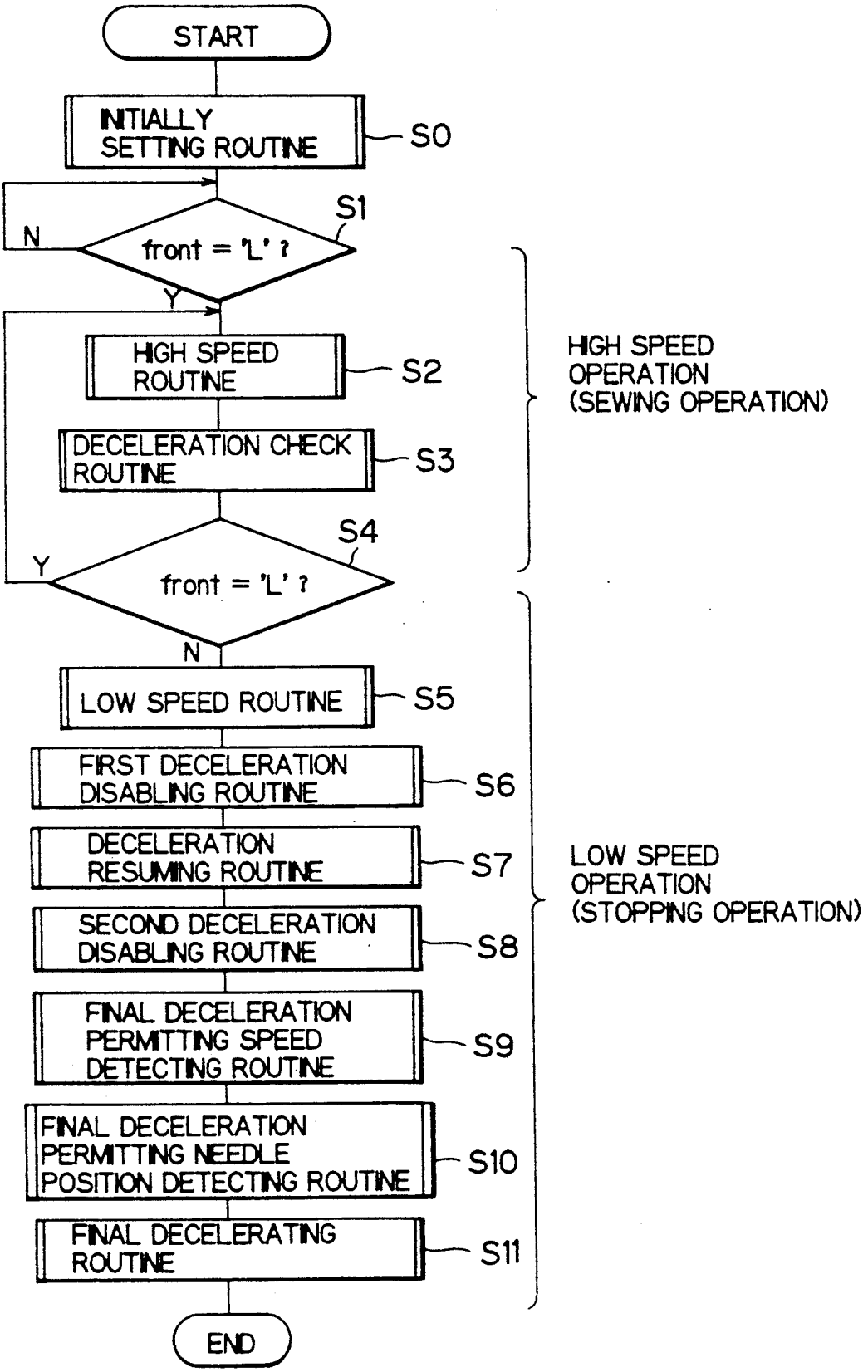
FIG. 6 is a flowchart of operation of the system according to the embodiment of the present invention.

In order to perform the sequential operations as shown in FIG. 5, the CPU 7j in the motor control unit 7 of the sewing machine 1 executes a plurality of routines S0 through S11 in sequence, as shown in FIG. 6.

At the time when the sewing machine 1 is energized through the operator's manipulation of a power switch (not shown in the drawing) mounted on the sewing machine frame, the CPU 7j executes a routine S0 for initially setting all the low speed operation command signal LOWSP, the high speed operation command signal HIGHSP, and the braking signal BRAKE to high levels "H". Then, the processing goes to the step S1 where the CPU 7j judges whether or not the signal FRONT is low level "L". In other words, the CPU judges whether or not the operator starts depressing the front region of the foot pedal 8. It is noted that since the front region of the foot pedal 8 is not depressed but is in its neutral position until the time TO as shown in FIG.

5, the actual rotational speed of the motor 6 is 0 until the time T0, and therefore, the actual speed signal VM issued from the motor 6 has also a value of 0.

At the time T0 when the front region of the foot pedal is started being depressed, the signal FRONT goes from "H" to "L" and the step goes to a high speed operation (steps S1 through S3). More specifically, the control goes to a high speed routine S2 of the high speed operation where the CPU 7j switches the signal HIGHSP from "H" to "L" to control the motor control unit 7 to perform the high speed operation, as shown in FIG. 5. Accordingly, the speed selecting circuit 7a issues the operator's desired speed signal Vp as the speed command signal Vs (objective motor speed), and therefore the motor control unit 7 controls the value of the actual speed VM of the motor to become equal to the value of the speed signal Vp. More specifically, the speed command comparing circuit 7c receives the speed command signal Vs and the actual speed signal VM, and outputs the differential speed command signal V0 which has a proper value for allowing the motor driving circuit 7f to control the motor 6 with a proper PMW signal so that the motor 6 may be rotated with the operator's desired speed Vp.

Since the depression amount of the foot pedal 8 gradually increases from the time T0 to T1 and continues to be fixed at the maximum amount from the time T1 to T2, the value of the signal Vp, i.e., the value of the signal Vs increases to be fixed to the maximum value (4000 rpm), as indicated by dotted line in FIG. 5. Since the motor 6 is controlled by the control unit 7 to attain the speed VM to be equal to the value Vs as described above, the actual speed VM also increases to the maximum speed (4000 rpm), as indicated by solid line in FIG. 5. Thus, the motor control unit 7 controls the motor 6 to rotate at the constant maximum speed of 4000 rpm.

Figure 7:
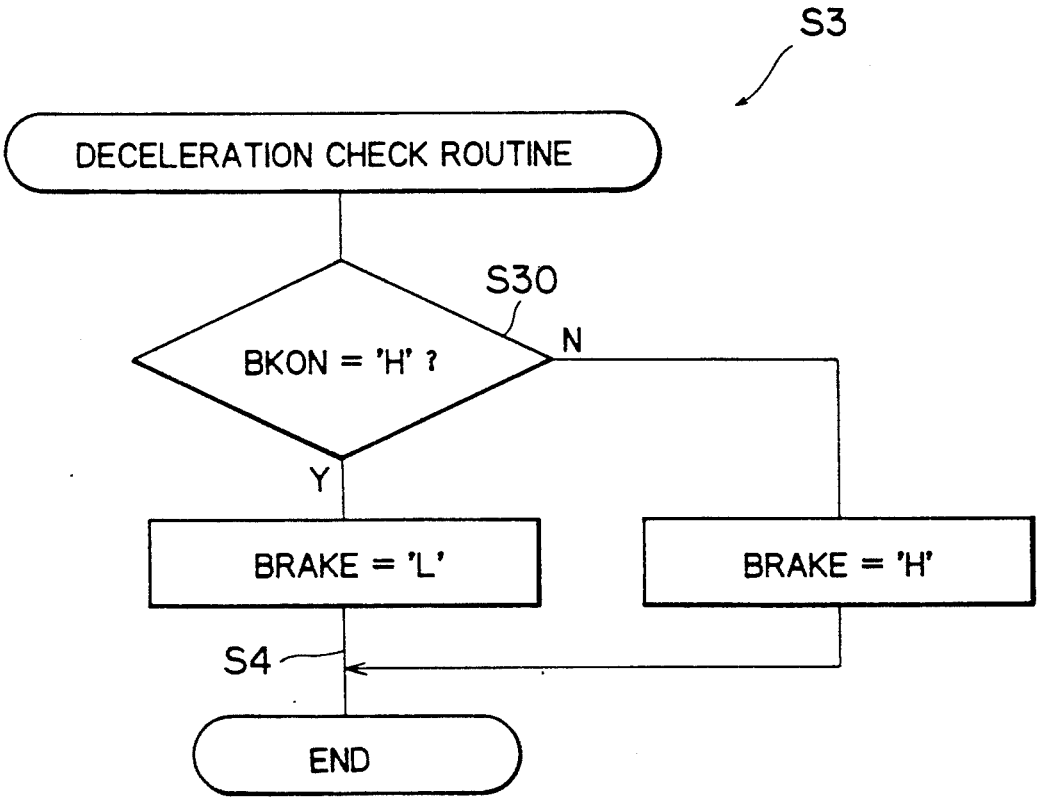
FIG. 7 is a flowchart of a deceleration checking routine according to the embodiment of the present invention.

While the above-described high speed routine S2 is conducted, a deceleration checking routine S3 is also conducted. In the deceleration checking routine S3, as shown in FIG. 7, the CPU 7j judges whether or not the deceleration command signal BKON is high, in a step S30. In the case where the signal BKON is "H", the CPU outputs the braking command signal BRAKE of "L" to engage the brake member 5 with the motor 6 and effectively decelerate the motor. In the case where the signal BKON is "L", the CPU outputs the signal BRAKE of "H" to disengage the brake member 5 from the motor 6.

More specifically, while the value of the operator's desired speed signal Vp (,i.e., the speed command signal Vs) is equal to or higher than the actual speed signal VM, the speed command comparing circuit 7c continues outputting the signal BKON of "L". Therefore, the CPU continues outputting the signal BRAKE of "H" to continue disengaging the brake member 5 from the motor 6. On the other hand, in the case where the operator starts decreasing the depression amount of the foot pedal 8, the value of the operator's desired speed signal Vp (the speed command signal Vs) becomes lower than that of the actual speed signal VM. At the time when the operator's desired signal Vp becomes lower than the actual speed signal VM by the certain value, the circuit 7c switches the signal BKON from "L" to "H". As a result, the CPU 7j changes the braking signal BRAKE from "H" to "L" and starts allowing the brake member 5 to be engaged with the motor 6 to thereby effectively decelerate the motor. (It is noted that at the time when the operator's desired speed signal Vp (Vs) becomes lower than the actual speed signal VM, the circuit 7c starts outputting the opposite phase command signal SG of low level "L", to reset the timer 7h and latch the signal BKOFF to "L".)

Then, the step goes to a step S4. Accordingly, the CPU 7j repeatedly executes the above-described high speed routine S2 and the deceleration checking routine S3, until the signal FRONT is changed from "L" to "H". In other words, during when the operator depresses the front region of the foot pedal 8, i.e., during when the signal FRONT is "L", the control unit 7 controls the motor 6 and the brake member 5 so that the motor 6 may be rotated with the operator's desired speed Vp (Vs). More specifically to say, while the operator's desired speed is equal to or higher than a speed which is lower than the actual speed by the certain value, the motor driving circuit 7f controls the rotational speed of the motor 6 to become equal to the desired speed, with the brake member 5 being disengaged from the motor. When the operator's desired speed is lower than the speed which is lower than the actual speed by the certain value, the brake member driving circuit 7g engages the brake member 5 with the motor 6 so that the rotational speed of the motor 6 may be decreased to the desired speed within a short period of time. Accordingly, the sewing machine 1 can perform the high speed operation (, i.e., the sewing operation) with the operator's desired sewing speed.

When the operator desires to stop the sewing operation, the operator starts decreasing the depression amount of the foot pedal 8, at the time T2 as shown in FIG. 5. Accordingly, similarly as described above, the comparing circuit 7c outputs the signal SG of "L" to allow the timer 7h to latch the signal BKOFF to "L" and then outputs the signal BKON of "H". As a result, in the routine S3, the CPU 7j changes the signal BRAKE from "H" to "L" to decelerate the motor 6. Then, at the time T3 when the operator stops depressing the foot pedal, i.e., the operator changes the foot pedal into its neutral position, the signal FRONT goes from "L" to "H". Thus, the control goes to a low speed operation (stopping operation; steps S5 through S11), through the step S4.

More specifically to say, at the time T3 when the signal FRONT goes from "L" to "H", the CPU 7j switches the signal HIGHSP from "L" to "H" and the signal LOWSP from "H" to "L", in a low speed routine S5. Accordingly, the speed selecting circuit 7a starts outputting the low speed signal VL as the speed command signal Vs.

Figure 8:
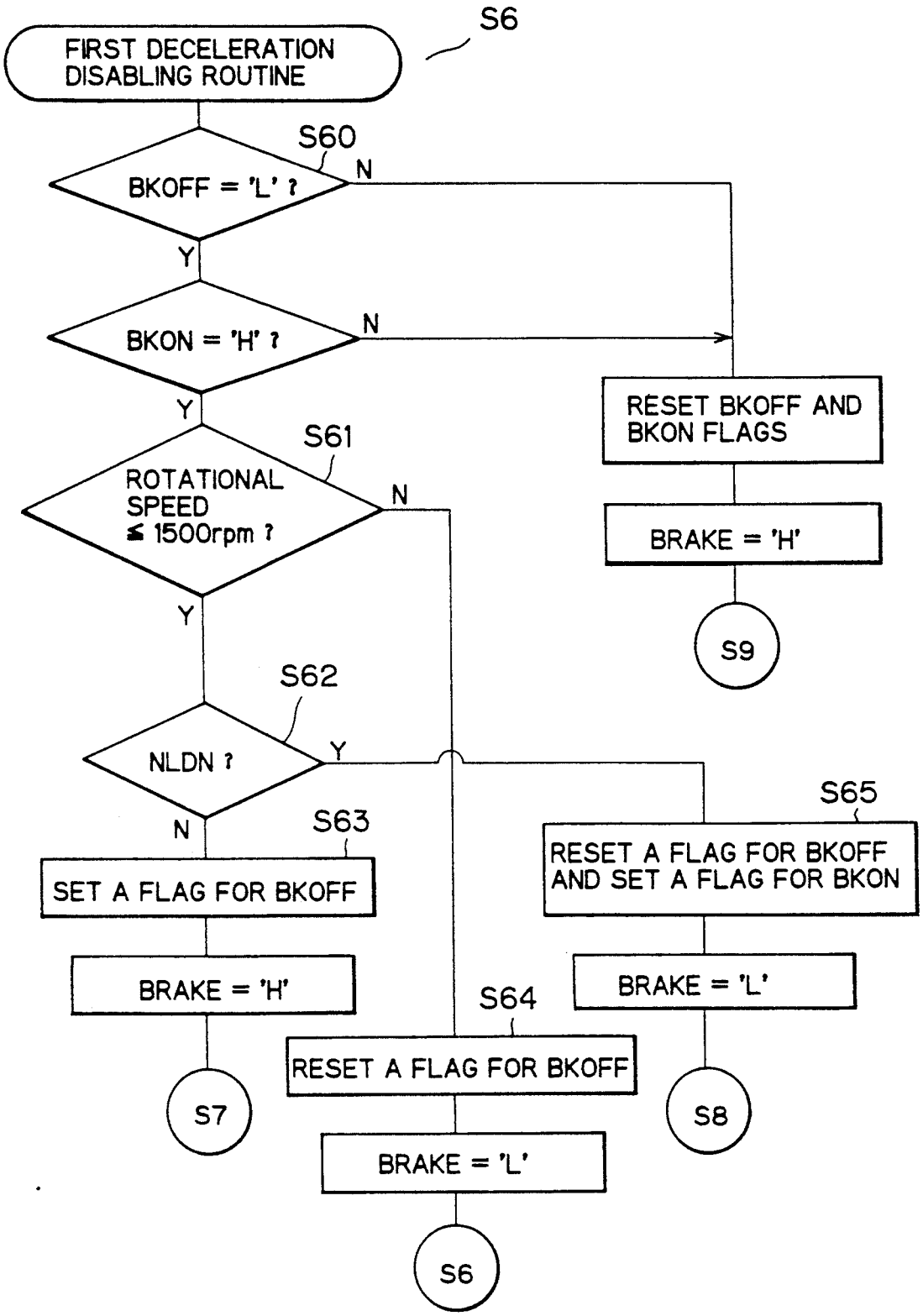
FIG. 8 is a flowchart of a first deceleration disabling routine according to the embodiment of the present invention.

Then, the control goes to a first deceleration disabling routine S6 shown in FIG. 8. In the first deceleration disabling routine S6, the CPU 7j continues allowing the brake member driving circuit 7g to control the brake member 5 to brake the rotation of the motor 6, until the CPU 7j detects the rotational speed of 1500 rpm of the upper main shaft. More specifically, in the routine S6, when the signal BKOFF is "L" and the signal BKON is "H", the steps S61 and S64 are repeatedly executed until the rotational speed of 1500 rpm is detected. (It should be noted that if the signal BKOFF is "H" or the signal BKON is "L", the CPU 7j resets flags for the signals BKOFF and BKON and then changes the signal BRAKE to "H" and executes a final deceleration permitting speed detecting routine S9 which will be described later.)

At the time T4 when the CPU 7j detects the rotational speed of 1500 rpm or less as shown in FIG. 5, the control goes to a step S62. In the step S62, the CPU 7j judges whether or not the needle lowermost position signal NLDN is received. In other words, the CPU judges whether or not the CPU detects the falling edge of the signal outputted from the position detector 2b. If the CPU detects the signal NLDN, the CPU continues the decelerating operation in a step S8 through a step S65. In this case, therefore, a deceleration disabling operation which will be described below is not conducted. On the other hand, in the case where the CPU does not detect the signal NLDN, in a step S63, the CPU sets a flag for the deceleration disabling signal BKOFF, in order to ignore the signal BKOFF of "L". In response to thus set BKOFF flag, the CPU changes the braking signal BRAKE from "L" to "H", irrespective of the deceleration command signal BKON of "H". As a result, the deceleration operation of the brake member 5 is disabled. In other words, the brake member 5 is disengaged from the motor 6. As a result, although the low speed signal VL is inputted to the comparing circuit 7c, the motor 6 is rotated due to inertia to keep the constant rotational speed of 1500 rpm.

It is noted, however, that the rotational speed actually continues being decreased after the time T4, due to a response delay of the brake member 5 with respect to the change of the braking signal BRAKE. Therefore, after the rotational speed is decreased to a value in a range of 1200 to 1300 rpm, the brake member 5 is completely separated from the motor 6 and the motor 6 is completely freely rotated, as shown in FIG. 5. It should be further noted that the rotational speed for determining the timing T4 at which the deceleration operation is disabled is not limited to the 1500 rpm, however, other values of rotational speed may be selected thereto. For example, a rotational speed of 1800 rpm may be selected.

Figure 9:
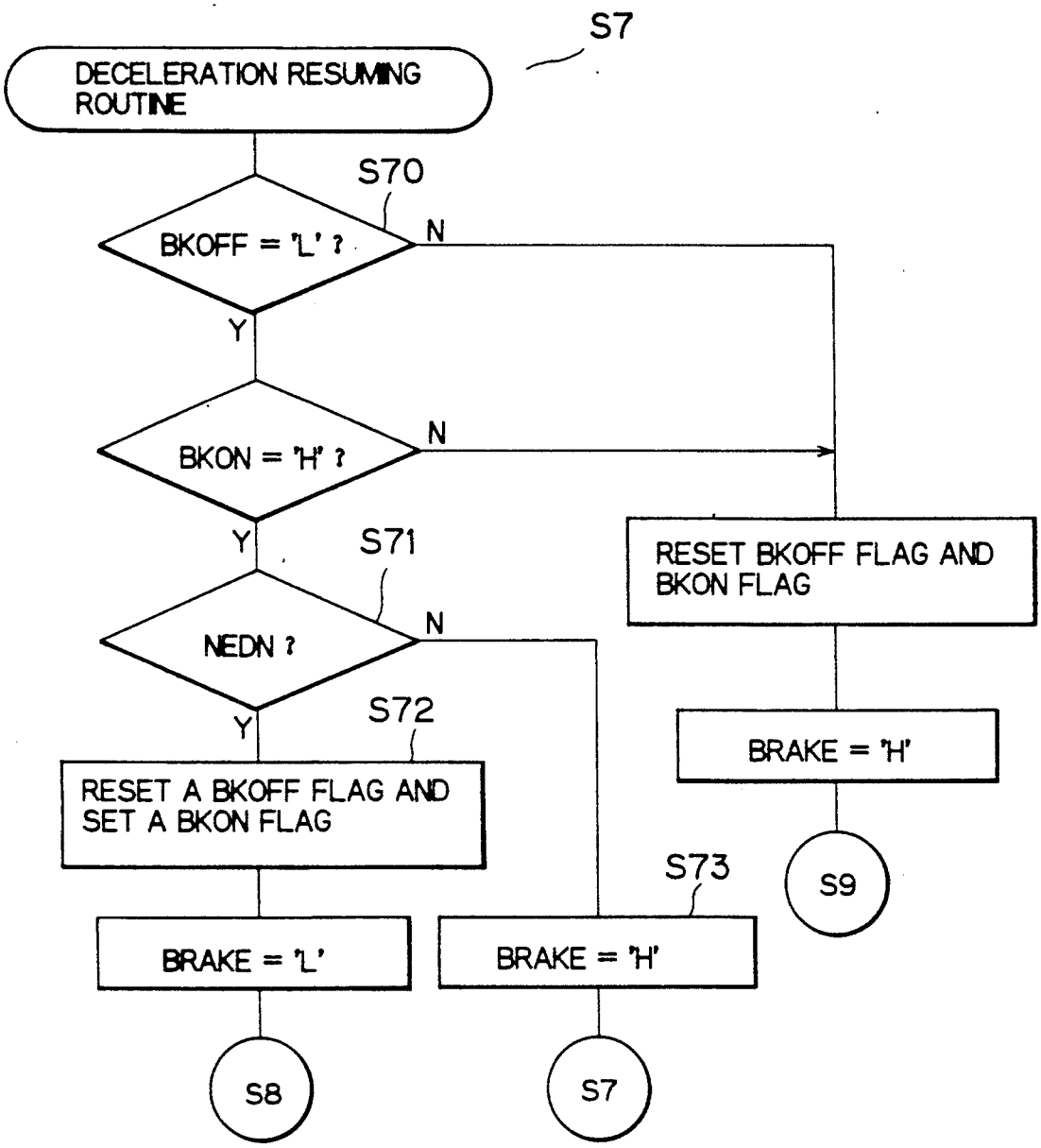
FIG. 9 is a flowchart of a deceleration resuming routine according to the embodiment of the present invention.

When the above-described deceleration disabling operation is started being performed, the control goes to a deceleration resuming routine S7. In the deceleration resuming routine S7, the CPU 7j continues disengaging the brake member 5 from the motor 6, until the CPU 7j detects the needle lowermost position signal NLDN, i.e., until the CPU detects the falling edge of the signal outputted from the position detector 2b. More specifically, in the routine S7, as shown in FIG. 9, in the case where the signal BKOFF is "L" and the signal BKON is "H", the steps S71 and S73 are repeatedly executed until the lowermost needle position signal NLDN is detected. (It should be noted that if the signal BKOFF is "H" or the signal BKON is "L", the CPU 7j resets flags for the signals BKOFF and BKON and then changes the signal BRAKE to "H" and executes the final deceleration permitting speed detecting routine S9 which will be described later.)

At the time T5 when the CPU 7j detects the falling edge of the signal outputted from the position detector 2b, the command goes to a step S72. In the step S72, the CPU resets the flag for the signal BKOFF, but sets the flag for the signal BKON, to thereby change the braking signal BRAKE from "H" to "L". Accordingly, the CPU controls the brake member 5 to resume decelerating the motor 6. Control then goes to a second deceleration disabling routine S8.

Figure 10:
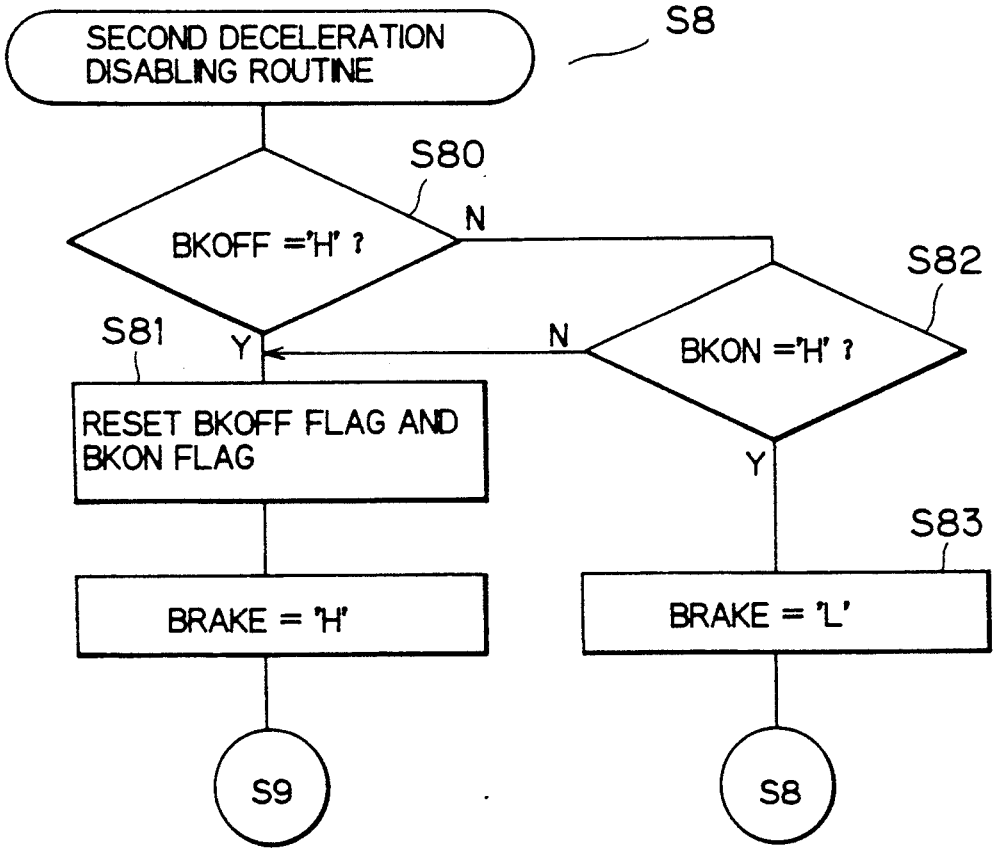
FIG. 10 is a flowchart of a second deceleration disabling routine according to the embodiment of the present invention.

In the second deceleration disabling routine S8, the CPU 7j continues allowing the brake member 5 to brake the rotation of the motor 6 to decelerate the motor 6, until the rotational speed of the upper main shaft reaches 500 rpm. Since the timer 7h in the control unit 7 has been set at the time T2 to latch the signal BKOFF to "L" until the rotational speed reaches 500 rpm or less, the timer 7h will be reset to output the signal BKOFF of "H" at the time when the rotational speed reaches 500 rpm or less. Accordingly, as shown in FIG. 10, until the rotational speed reaches 500 rpm or less, i.e., until the CPU 7j receives the signal BKOFF of "H", the steps S80, S82 and S83 are repeatedly conducted. That is, since the CPU 7j continues outputting the signal BRAKE of "L" in the step S83, the deceleration of the motor 6 continues being performed. At the time T6 when the rotational speed reaches 500 rpm and the signal BKOFF is changed to "H", the control goes to a step S81 where the CPU resets the flags for the signals BKOFF and BKON. Then, the CPU outputs the signal BRAKE of "H", to disable the deceleration operation.

It is noted that the value of the rotational speed for determining the timing T6 at which the deceleration operation is disabled is selected to 500 rpm in view of the response delay of the brake member 5 with respect to the braking signal. More specifically to say, in the case where the braking signal BRAKE is changed to "H" at the time T6 when the rotational speed is 500 rpm, the brake member 5 actually continues braking the motor to further decrease the rotational speed. Then, when the rotational speed becomes the low speed of 200 rpm, the motor is completely separated from the brake member 5 to completely freely rotate.

It should be further noted that it is possible to vary the time constant of the CR circuit of the timer 7h in accordance with the response delay of the brake member 5. Accordingly, it is possible to freely select the rotational speed for determining the timing T6 at which the deceleration operation is disabled. Therefore, the rotational speed for determining the timing at which the deceleration operation is disabled is not limited to 500 rpm.

Then, control goes to the final deceleration permitting speed detecting routine S9. In the routine S9, the CPU 7j judges whether or not the rotational speed of the upper main shaft reaches 300 rpm. At the timing T7 when the rotational speed of 300 rpm is detected, as shown in FIG. 5, the control further goes to a final deceleration permitting needle position detecting routine S10. In the routine S10, the CPU 7j judges whether or not the needle lowermost position signal NLDN is detected. At the timing T8 when the CPU detects the signal NLDN, as shown in FIG. 5, the control goes to a final deceleration routine S11 where the CPU 7j changes the signal LOWSP from "L" to "H" and the signal BRAKE from "H" to "L". Accordingly, the CPU allows the brake member 5 to further decelerate the rotation of the motor 6 to thereby completely stop the rotation of the motor. As a result, the motor 6 is completely stopped rotating.

To summarize, as shown in FIG. 5, at the time T3 when the foot pedal 8 is stopped being depressed and the signal FRONT goes from "L" to "H", the stopping operation of the sewing machine according to the present invention is started to be conducted. In the stopping operation, the sewing machine is first decelerated until the time T4 when the rotational speed of 1500 rpm is detected. At the time T4 when the speed of 1500 rpm is detected, the deceleration operation is disabled. That is, the signal BRAKE is changed from "L" to "H". However, the rotational speed of the sewing machine continues decreasing to a middle rotational speed Nb which falls in the range of about 1200 through 1300 rpm, due to a response delay of the brake member with respect to the change of the braking signal BRAKE. Then, the sewing machine continues to rotate at the constant speed Nb. At the time T5 when the lowermost needle position is detected, the deceleration operation is started again, and the deceleration operation continues being conducted until the time T6 when the rotational speed of 500 rpm is detected. At the timing T6 when the speed of 500 rpm is detected, the deceleration operation is again disabled. However, similarly as described above, though the deceleration operation is thus disabled, the rotational speed continues decreasing to a low speed Na of 200 rpm, due to the response delay of the brake member. Then, the sewing machine rotate at the constant speed Na of 200 rpm. At the timing T8 when the lowermost needle position is detected, the sewing machine is finally decelerated to be completely stopped.

As apparent from the above, according to the present invention, when the stopping operation is started at the timing T3, the rotational speed N of the sewing machine is first decelerated to the middle speed Nb. Then, the sewing machine is controlled to rotate at the constant middle speed Nb. During the time sewing machine is rotated at the constant speed Nb, at the time T5-when the lowermost needle position is detected, the sewing machine is again started being decelerated. The speed is then decreased to the low speed Na. Then, the sewing machine is controlled to rotate with the constant low speed Na. During the time sewing machine is rotated at the constant low speed Na, at the time T8 when the lowermost needle position is detected, the sewing machine is finally decelerated to be completely stopped.

According to the present invention, therefore, the period of time L11 from the time T5 to the time T8 is always constant. Accordingly the change of the period of time L12 from the time T3 to the time T8 which is required for stopping the sewing machine depends on the change of the period of time L13 in which the sewing machine is rotated at the constant middle speed Nb. However, since the middle speed Nb is higher than the low speed Na, the change of the period of time L13 is limited to very short. Accordingly, it becomes possible to make almost constant the period of time L12 required for the respective stopping operation. Therefore, it becomes possible to make uniform the rhythms of the stopping operations.

In addition, according to the present invention, as described above, the speed of 300 rpm is defined for determining the timing from which the sewing machine is permitted to be finally decelerated to be stopped. Therefore, if the lowermost needle position is detected before the time rotational speed reaches the low speed of 200 rpm, the deceleration operation will be conducted while the motor is rotated with a speed higher than the low speed of 200 rpm. Accordingly, an actual stopping position will be displaced from a desired stopping position, and therefore a stopping accuracy will be largely deteriorated. The stopping operation of the present invention, however, solves such a problem, as follows. According to the present invention, the value of the middle speed Nb, i.e., the speed of 1500 rpm for determining the timing T4 at which the deceleration operation is disabled and the needle position (lowermost needle position) for determining the timing T5 at which the deceleration operation is resumed are selected so that the value of the rotating phase amount P of the main shaft to be attained from the time T7 when the speed of 300 rpm is detected to the time T8 when the needle lowermost position is detected may become equal to higher than a certain value. Accordingly, the needle lowermost position cannot be detected while the sewing machine is rotated with a speed higher than 200 rpm, but the needle lowermost position can be detected only during when the sewing machine is rotated with the low speed of 200 rpm. Accordingly, the actual stopping position may not be shifted from the desired stopping position.

As apparent from the above, the value of the speed (1500 rpm) for determining the timing T4 at which the deceleration is disabled and the needle position (lowermost needle position) for determining the timing T5 at which the deceleration is resumed are selected, in view of the response delay of the brake member 5, etc., so that the rotating phase amount P may become equal to or higher than the certain value and the lowermost needle position may be detected only while the main shaft is rotating at the low speed Na (200 rpm). Therefore, the speed for determining the time T4 at which the deceleration is disabled is not limited to 1500 rpm. Furthermore, the needle position for determining the time T5 at which the deceleration is resumed is not limited to the lowermost position. For example, such a needle position as shifted from the lowermost position by a phase of 45 degrees (three ENC pulses) can also be selected.

Furthermore, in the control system of the present invention, the rotational phase amount P of the main shaft attained between the time T7 and the time T8 may be detected in one sewing operation. Then, in a sewing operation conducted next to the sewing operation, the needle position for determining the time T5 at which the deceleration operation is resumed may be determined based on the detected rotational phase amount P. Such a phase amount feedback operation may be preferable for selecting such a needle position as for determining the time T5 to allow the lowermost needle position to be detected only while the main shaft is rotating at the low speed Na (200 rpm).

As described above, the stopping control process according to the present invention includes a deceleration disabling interval L13 (T4→T5 in FIG. 5). The deceleration disabling interval L13 is effective to reduce varying stopping modes when the sewing machine is brought from a high-speed operation to a stopped state so that the sewing machine will operate highly efficiently. Furthermore, since the sewing machine is finally stopped at a certain needle position while the sewing machine is rotated at a constant low speed (200 rpm), stopping accuracy differences can be minimized.

While the present invention has been described in detail and with reference to specific embodiment thereof, it will be apparent to one skilled in the art that various changes and modifications can be made therein without departing from the spirit and scope thereof.

For example, while the sewing machine is stopped at the lowermost needle position in the above embodiment, it may be stopped at the uppermost needle position according to the same control process.

I claim:

1. A method of stopping a motor of a sewing machine whig is rotating a main shaft of the sewing machine at an initial rotational speed, comprising the steps of:

judging whether or not an initial rotational speed of a main shaft which is rotated by a motor of a sewing machine is higher than a predetermined middle rotational speed, and decelerating the motor to decrease a rotational speed of the main shaft form the initial rotational speed toward the middle rotational speed, in the case where the initial rotational speed is higher than the middle rotational speed;

resuming deceleration of the motor at a first deceleration time when a needle operatively coupled to the main shaft is in a predetermined first position while the main shaft is rotating at a rotational speed equal to the middle rotational speed so that the rotational speed of the main shaft may be decreased from the middle rotational speed via a predetermined stop permission rotational speed which is lower than the middle rotational speed toward a predetermined low rotational speed which is lower than the stop permission rotational speed, a value of the middle rotational speed and the first position of the needle being determined to prevent the needle from reaching a predetermined second position during the time the rotational speed decreases from the stop permission rotational speed toward the low rotational speed;

judging whether or not the rotational speed of the main shaft reaches the stop permission rotational speed; and resuming deceleration of the motor at a second deceleration time when the needle first reaches a predetermined second position after the rotational speed is judged to reach the stop permission rotational speed, to thereby completely stop the motor at the second deceleration time when the needle is in the second position and the main shaft is rotating at the low rotational speed.

2. A method of stopping a motor of a sewing machine as claimed in claim 1, further comprising the step of interrupting the deceleration of the motor to decrease the rotational speed of the main shaft from the initial rotational speed toward the middle rotational speed, at a first interruption time when the rotational speed reaches the middle rotational speed, to thereby allow the motor to continue rotating the main shaft at the middle rotational speed until the first deceleration time when the needle first reaches the first position after the first interruption time.

3. A method of stopping a motor of a sewing machine as claimed in claim 2, further comprising the step of interrupting the deceleration of the motor to decrease the rotational speed of the main shaft from the middle rotational speed toward the low rotational speed, at a second interruption time when the main shaft rotational speed reaches the low rotational speed, to thereby allow the motor to continue rotating the main shaft at the low rotational speed until the second deceleration time when the needle first reaches the second position after the main shaft rotational speed reaches the stop permission rotational speed.

4. A method of stopping a motor of a sewing machine as claimed in claim 3, wherein the sewing machine includes a brake member for decelerating the motor, a control unit for allowing the brake member to start decelerating the motor, a speed detecting unit for detecting the rotational speed of the main shaft, and a needle position detecting unit for detecting the needle position, and wherein said step of resuming deceleration of the motor at the first deceleration time includes the step of allowing the control unit to control the brake member to start decelerating the motor at the first deceleration time when the position detecting unit detects that the needle first reaches the first position after the rotational speed of the main shaft reaches the middle rotational speed while the main shaft is rotating at the rotational speed equal to the middle rotational speed, the value of the middle rotational speed and the first position of the needle being determined to allow the brake member to decelerate the motor in such a manner as to prevent the needle from reaching the second position until the rotational speed decreasing from the stop permission rotational speed reaches the low rotational speed, and said step of resuming the deceleration of the motor at the second deceleration time includes the step of allowing the control unit to control the brake member to start decelerating the motor at the second deceleration time when the position detecting unit detects that the needle first reaches the second position after the speed detecting unit detects that the rotational speed of the main shaft reaches the stop permission rotational speed, to thereby enable the brake member to completely stop the motor at the second deceleration time when the needle is in the second position while the main shaft is rotating at the low rotational speed.

5. A method of stopping a motor of a sewing machine as claimed in claim 4, wherein the control unit switches a braking command signal between first and second levels and supplies the brake member with the braking command signal, the braking command signal of the first level allowing the brake member to decelerate the motor and the braking command signal of the second level interrupting deceleration operation of the brake member, and wherein the control unit supplies the brake member with the braking command signal of the first level, in the case where the initial rotational speed is detected to be higher than the middle rotational speed, to thereby allow the brake member to decelerate the motor so as to decrease the rotational speed of the main shaft from the initial rotational speed, the control unit then switches the braking command signal from the first level to the second level, at a third interruption time different from the first interruption time when the main shaft rotational speed reaches a predetermined first rotational speed which is higher than the middle rotational speed by a predetermined first difference value so that the brake member may continue decelerating the motor, due to response delay of the brake member with respect to the braking command signal, to decrease the main shaft rotational speed from the first rotational speed toward the middle rotational speed and then the motor may continue rotating the main shaft with its rotational speed being fixed at the middle rotational speed, the control unit then switches the braking command signal from the second level to the first level while the main shaft is rotating at the middle rotational speed, at the first deceleration time when the position detecting unit detects that the needle first reaches the first position after the third interruption time, to thereby allow the brake member to decelerate the motor to decrease the rotational speed from the middle rotational speed, the value of the middle rotational speed and the first position of the needle being determined to allow the brake member to decelerate the motor in such a manner as to prevent the needle from reaching the second position while the rotational speed decreases from the stop permission rotational speed toward the low rotational speed, the control unit then switches the braking command signal from the first level to the second level, at a fourth interruption time different from the second interruption time when the main shaft rotational speed reaches a predetermined second rotational speed which is higher than the low rotational speed by a predetermined second difference value so that the brake member may continue decelerating the motor, due to response delay of the brake member with respect to the braking command signal, to decrease the main shaft rotational speed from the second rotational speed via the stop permission rotational speed toward the low rotational speed and then the motor may continue rotating the main shaft with its rotational speed being fixed to the low rotational speed, the speed detecting unit then detects the rotational speed of the main shaft to thereby judge whether or not the rotational speed reaches the stop permission rotational speed, and the control unit switches the braking command signal from the second level to the first level, at the second deceleration time when the position detecting unit detects that the needle first reaches the second position after the speed detecting unit detects that the rotational speed of the main shaft reaches the stop permission rotational speed, to thereby enable the brake member to completely stop the motor when the main shaft is rotating at the low rotational speed.

6. In a sewing machine which includes a motor, a main shaft driven to be rotated by the motor, a needle operatively coupled to the main shaft, a decelerating unit for decelerating the motor so as to decrease a rotational speed of the main shaft at a fixed rate, a speed detecting unit for detecting a rotational speed of the main shaft which represents a shifting speed of phase of the rotating main shaft, a position detecting unit for detecting a position of the needle which represents a shifting amount of phase of the rotating main shaft, and a control unit for receiving a stop command and controlling the decelerating unit to perform a stopping operation of the motor in response to the stop command, a method of stopping the motor of the sewing machine comprising the steps of:

controlling the speed detecting unit to detect an initial rotational speed of the main shaft at a time when the control unit receives the stop command and judging whether or not the initial rotational speed of the main shaft is higher than a predetermined middle rotational speed;

controlling the decelerating unit to decelerate the motor so that the rotational speed of the main shaft may be decreased from the initial rotational speed toward the middle rotational speed, in the case where the initial rotational speed is judged to be higher than the middle rotational speed;

interrupting the deceleration operation of the decelerating unit at a first interruption time when the rotational speed of the main shaft reaches the middle rotational speed so as to allow the motor to continue rotating the main shaft at the middle rotational speed until a first deceleration time when a needle operatively coupled to the main shaft first reaches a predetermined first position after the first interruption time;

controlling the decelerating unit to resume the deceleration operation, at the first deceleration time when the needle first reaches the predetermined first position while the main shaft is rotating at a rotational speed equal to the middle rotational speed, so that the rotational speed of the main shaft may be decreased from the middle rotational speed via a stop permission rotational speed which is lower than the middle rotational speed toward a low rotational speed whig is lower than the stop permission rotational speed, the middle rotational speed and the first position of the needle being determined dependently on the fixed rate of the decelerating unit to allow a phase amount of the rotating main shaft to be attained between the first deceleration time when the main shaft is rotating at the middle rotational speed and the needle is in the first position and a second deceleration time when the needle first reaches a predetermined second position after when the rotational speed of the main shaft reaches the stop permission rotational speed to have such a value as prevents the needle from reaching the second position while the rotational speed decreases from the stop permission rotational speed toward the low rotational speed;

judging whether or not the rotational speed of the main shaft reaches the stop permission rotational speed;

interrupting the deceleration operation of the decelerating unit at the second interruption time when the rotational speed of the main shaft reaches the low rotational speed so as to allow the motor to continue rotating the main shaft at the low rotational speed; and controlling the decelerating unit to resume the deceleration of the motor at the second deceleration time when the needle first reaches the second position after the rotational speed is judged to reach the stop permission rotational speed, to thereby completely stop the motor at the second deceleration time when the needle is in the second position and the main shaft is rotating at the low rotational speed.

7. A method of stopping the motor as claimed in claim 6, wherein the control unit supplies the decelerating unit with a deceleration command signal for allowing the deceleration unit to start decelerating the motor, and wherein the control unit supplies the deceleration unit with the decelerating command signal at the time when the control unit receives the stop command, at the first deceleration time when the needle first reaches the first position after the first interruption time while the main shaft is rotating at the rotational speed equal to the middle rotational speed, and at the second deceleration time when the needle first reaches the second position after the rotational speed reaches the stop permission rotational speed while the main shaft is rotating at the low rotational speed.

8. A method of stopping a motor of a sewing machine as claimed in claim 7, wherein the control unit further supplies the decelerating unit with a deceleration disabling command signal for allowing the deceleration unit to stop decelerating the motor, and wherein the control unit supplies the deceleration unit with the deceleration disabling command signal at a third interruption time different from the first interruption time when the main shaft rotational speed reaches a predetermined first rotational speed which is higher than the middle rotational speed by a predetermined first difference value so that the deceleration unit may continue decelerating the motor, due to response delay of the deceleration unit with respect to the deceleration disabling command signal, to decrease the main shaft rotational speed from the first rotational speed toward the middle rotational speed and then the motor may continue rotating the main shaft with its rotational speed being fixed to the middle rotational speed.

9. A method of stopping a motor of a sewing machine as claimed in claim 8, wherein the control unit further supplies the decelerating unit with the deceleration disabling command signal at a fourth interruption time when the main shaft rotational speed reaches a predetermined second rotational speed which is higher than the low rotational speed by a predetermined second difference value so that the decelerating unit may continue decelerating the motor, due to response delay of the decelerating unit with respect to the deceleration disabling command, to decrease the main shaft rotational speed from the second rotational speed toward the low rotational speed and then the motor may continue rotating the main shaft with its rotational speed being fixed to the low rotational speed.

10. A system for controlling the stopping operation of a sewing machine, comprising:

a speed detecting unit for detecting a rotational speed of a main shaft of the sewing machine which is driven to be rotated by a motor of the sewing machine;

a position detecting unit for detecting a position of a needle of the sewing machine which is operatively coupled to the main shaft;

a command producing unit for producing a decelerating command for decelerating the motor;

a decelerating unit for receiving the decelerating command and decelerating the motor in response thereto;

first deceleration disabling means for disabling the deceleration operation of said decelerating unit irrespective of the decelerating command, at a first disable time when the rotational speed becomes equal to a predetermined middle rotational speed, after said decelerating unit receives the decelerating command, to thereby allow the motor to continue rotating the main shaft at the middle rotational speed from the first disable time until a first deceleration time when the position detecting unit detects that the needle first reaches a predetermined first position after the first disable time;

first deceleration resuming means for resuming the deceleration operation of said decelerating unit in accordance with the decelerating command, at the first deceleration time, to thereby decrease the main shaft rotational speed from the middle rotational speed via a stop permission rotational speed which is lower than the middle rotational speed toward a low rotational speed which is lower than the stop permission rotational speed, the middle rotational speed and the first position of the needle being determined to allow said decelerating unit to decelerate the motor in such a manner as to prevent the needle from reaching a predetermined second position while the rotational speed decreases from the stop permission rotational speed toward the low rotational speed;

second deceleration disabling means for disabling the deceleration operation of said decelerating unit irrespective of the decelerating command, at a second disable time when the rotational speed reaches the low rotational speed, to thereby allow the motor to continue rotating the main shaft at the low rotational speed from the second disable time until a second deceleration time when the position detecting unit detects that the needle first reaches a predetermined second position after the speed detecting unit detects that the rotational speed reaches the stop permission rotational speed; and second deceleration resuming means for resuming the deceleration operation of said decelerating unit in accordance with the decelerating command, at the second deceleration time, to thereby completely stop the motor, at the second deceleration time when said position detecting unit detects that the needle first reaches the second needle position while the main shaft is rotating at the low rotational speed.

11. A system for controlling the stopping operation of a sewing machine as claimed in claim 10, wherein said first deceleration disabling means supplies said decelerating unit with a disabling command for disabling the decelerating command applied to said decelerating unit, at a third disable time different from the first disable time when said speed detecting unit detects that the rotational speed of the main shaft reaches a predetermined first rotational speed which is higher than the middle rotational speed by a predetermined first difference value, so that said decelerating unit may continue decelerating the motor, due to response delay of said decelerating unit with the disabling command, to decrease the rotational speed of the main shaft from the first rotational speed to the middle rotational speed and then the motor may continue rotating the main shaft with its rotational speed being fixed at the middle rotational speed.

12. A system for controlling the stopping operation of a sewing machine as claimed in claim 11, wherein said second deceleration disabling means supplies said decelerating unit with a disabling command for disabling the decelerating command applied to said decelerating unit, at a fourth disable time different from the second disable time when said speed detecting unit detects that the rotational speed of the main shaft reaches a predetermined second rotational speed which is higher than the low rotational speed by a predetermined second difference value, so that said decelerating unit may continue decelerating the motor, due to response delay of said decelerating unit with the deceleration disabling command, to decrease the rotational speed of the main shaft from the second rotational speed to the low rotational speed and then the motor may continue rotating the main shaft with its rotational speed being fixed to the low rotational speed.

13. A system for controlling the stopping operation of a sewing machine as claimed in claim 12, wherein said speed detecting unit produces an actual speed command indicative of the rotational speed of the main shaft detected thereby, wherein said command producing unit comprises:

a first speed command generating unit for generating a sewing operation start command, a sewing operation stop command and a high speed command which are determined dependently on a depression state of an operating pedal;

a second speed command generating unit for generating a low speed command;

a speed selecting unit for selecting one of the high speed command and the low speed command, said speed selecting unit selecting the high speed command after said first speed command generating unit generates the sewing operation start command until said first speed command generating unit generates the sewing operation stop command and said speed selecting unit selecting the low speed command after said speed command generating unit generates the sewing operation stop command; and a speed command comparing unit for comparing one of the high speed command and the low speed command selected by said speed selecting unit with the actual speed command, said speed command comparing unit generating the decelerating command at least after said first speed command generating unit generates the sewing operation stop command and applying the decelerating command to said decelerating unit, said speed command comparing unit generating a drive command at least after said first speed command generating unit generates the sewing operation start command, the drive command being determined dependently on a difference value between the speed command selected by said speed selecting unit and the actual speed command; and wherein said system further comprises a motor driving unit connected to said speed command comparing unit, for receiving the drive command and driving the motor based on the drive command, to thereby control the motor to rotate the main shaft with a rotational speed equal to a speed represented by the high speed command.

14. A method of stopping a motor of a sewing machine as claimed in claim 1, wherein the rotational speed of the main shaft represents a shifting velocity of phase of the rotating main shaft and the position of the needle represents a shifting amount of phase of the rotating main shaft, and wherein the middle rotational speed and the first position of the needle are determined to allow a phase amount of the rotating main shaft to be attained between the first deceleration time and the second deceleration time to have such a value as prevents the needle from reaching the second position until the rotational speed decreasing from the stop permission rotational speed reaches the low rotational speed.

15. A method of stopping the motor as claimed in claim 14, wherein the middle rotational speed and the first position of the needle are determined to allow a phase amount of the rotating main shaft to be attained between a time when the rotational speed of the main shaft reaches the stop permission rotational speed and the second deceleration time when the needle first reaches the second position after the rotational speed of the main shaft reaches the stop permission rotational speed to have a value equal to or larger than a predetermined value to thereby prevent the needle from reaching the second position until the rotational speed decreasing from the stop permission rotational speed reaches the low rotational speed.

16. A method of stopping a motor of a sewing machine as claimed in claim 4, wherein the decelerating unit decelerates the motor so as to decrease a rotational speed of the main shaft at a fixed rate, the speed detecting unit detects the rotational speed of the main shaft which represents a shift in speed of phase of the rotating main shaft, and the position detecting unit detects the position of the needle which represents a shifting amount of phase of the rotating main shaft, and wherein the middle rotational speed and the first position of the needle are determined dependently on the fixed rate of the brake member, with which the brake member decreases the main shaft rotational speed, to allow a phase amount of the rotating main shaft to be attained between the first deceleration time and the second deceleration time to have such a value as prevents the needle from reaching the second position until the rotational speed decreasing from the stop permission rotational speed reaches the low rotational speed.

17. A method of stopping the motor as claimed in claim 16, wherein the middle rotational speed and the first position of the needle are determined dependently on the fixed rate, with which the brake member decreases the rotational speed, to allow a phase amount of the rotating main shaft to be attained between a time when the rotational speed of the main shaft reaches the stop permission rotational speed and the second deceleration time when the needle first reaches the second position after the rotational speed of the main shaft thus reaches the stop permission rotational speed to have a value equal to or larger than a predetermined value to thereby prevent the needle from reaching the second position until the rotational speed decreasing from the stop permission rotational speed reaches the low rotational speed.

18. A method of stopping a motor of a sewing machine as claimed in claim 5, wherein the sewing machine further includes a time period counting unit for counting a time period from the first deceleration time when the brake member resumes deceleration of the motor, and wherein the control unit judges whether or not the time period counted by the time period counting unit reaches a predetermined time period which is determined dependently on a fixed rate, with which the brake member decelerates the motor to decrease the main shaft rotational speed, to define the time period between the first deceleration time and the fourth interruption time, and switches the braking command signal from the first level to the second level at the fourth interruption time thus judged by the control unit.

19. A method of stopping the motor as claimed in claim 6, wherein the middle rotational speed and the first position of the needle are determined dependently on the fixed rate, with which the decelerating unit decreases the rotational speed, to allow a phase amount of the rotating main shaft to be attained between a time when the rotational speed of the main shaft reaches the stop permission rotational speed and the second deceleration time when the needle first reaches the second position after the rotational speed of the main shaft thus reaches the stop permission rotational speed to have a value equal to or larger than a predetermined value to thereby prevent the needle from reaching the second position until the rotational speed decreasing from the stop permission rotational speed reaches the low rotational speed.

20. A system for controlling the stopping operation of a sewing machine as claimed in claim 10, wherein the rotational speed of the main shaft represents a shifting speed of phase of the rotating main shaft and the position of the needle represents a shifting amount of phase of the rotating main shaft, and wherein the middle rotational speed and the first position of the needle are determined to allow a phase amount of the rotating main shaft to be attained between the first deceleration time and the second deceleration time to have such a value as prevents the needle from reaching the second position until the rotational speed decreasing from the stop permission rotational speed reaches the low rotational speed.

21. A system for controlling the stopping operation of a sewing machine as claimed in claim 20, wherein the middle rotational speed and the first position of the needle are determined to allow a phase amount of the rotating main shaft to be attained between a time when the rotational speed of the main shaft reaches the stop permission rotational speed and the second deceleration time when the needle first reaches the second position after when the rotational speed of the main shaft thus reaches the stop permission rotational speed to have a value equal to or larger than a predetermined value to thereby prevent the needle from reaching the second position until the rotational speed decreasing from the stop permission rotational speed reaches the low rotational speed.

22. A system for controlling the stopping operation of a sewing machine as claimed in claim 21, further comprising:

a phase amount detecting unit for detecting the phase amount of the rotating main shaft attained between the time when the speed detecting unit detects that the rotational speed of the main shaft reaches the stop permission rotational speed and the second deceleration time when the position detecting unit detects that the needle first reaches the second position after the rotational speed of the main shaft reaches the stop permission rotational speed; and feedback control means for controlling said first deceleration disabling means and said first deceleration resuming means in accordance with the phase amount detected by said phase amount detecting unit, to thereby adjust the middle rotational speed and the first position so that the phase amount may have a value equal to or larger than such a value as prevents the needle from reaching the second position until the rotational speed decreasing from the stop permission rotational speed reaches the low rotational speed.

23. In a sewing machine which includes a motor, a main shaft driven to be rotated by the motor, a needle operatively coupled to the main shaft, a decelerating unit for decelerating the motor so as to decrease a rotational speed of the main shaft at a fixed rate, a speed detecting unit for detecting a rotational speed of the main shaft which represents a shifting speed of phase of the rotational main shaft, and a position detecting unit for detecting a position of the needle which represents a shifting amount of phase of the rotating main shaft, a method of stopping the motor of the sewing machine which is rotating the main shaft at an initial rotational speed comprising the steps of:

decelerating the motor so that the rotational speed of the main shaft may be decreased from the initial rotational speed toward a predetermined middle rotational speed, in the case where the initial rotational speed is higher than the middle rotational speed;

interrupting the deceleration operation of the decelerating unit at a first interruption time when the rotational speed of the main shaft reaches the middle rotational speed so as to allow the motor to continue rotating the main shaft at the middle rotational speed until a first deceleration time when the needle first reaches a predetermined first position after the first interruption time;

resuming the deceleration operation at the first deceleration time so that the rotational speed of the main shaft may be decreased from the middle rotational speed toward a low rotational speed which is lower than the middle rotational speed, the middle rotational speed and the first position of the needle being determined dependently on the fixed rate of the decelerating unit, with which the decelerating unit decreases the rotational speed, to allow a phase amount of the rotating main shaft to be attained between the first deceleration time and a second deceleration time when the needle first reaches a predetermined second position after the first deceleration time to have such a value as prevents the needle from reaching the second position until the rotational speed reaches the low rotational speed;

interrupting the deceleration operation of the decelerating unit at the second interruption time when the rotational speed of the main shaft reaches the low rotational speed so as to allow the motor to continue rotating the main shaft at the low rotational speed; and resuming the deceleration operation at the second deceleration time, to thereby completely stop the motor at the second deceleration time when the needle is in the second position and the main shaft is rotating at the low rotational speed.

* * * * *